US006334286B1

(12) United States Patent
Zambelli et al.

(10) Patent No.: US 6,334,286 B1
(45) Date of Patent: Jan. 1, 2002

(54) DEVICE FOR LIFTING PREFABRICATED COMPONENTS, PARTICULARLY MADE OF CONCRETE, OR THE LIKE

(76) Inventors: Sergio Zambelli, Via Stezzano, 28; Benito Zambelli, Via Roma, 44, both of 24050 Zanica (Prov. of Bergamo) (IT)

( * ) Notice: Subject to any disclaimer, the term of this patent is extended or adjusted under 35 U.S.C. 154(b) by 0 days.

(21) Appl. No.: 09/572,726

(22) Filed: May 17, 2000

Related U.S. Application Data

(62) Division of application No. 08/937,692, filed on Sep. 29, 1997, now Pat. No. 6,092,849.

(30) Foreign Application Priority Data

Sep. 30, 1996 (IT) ..... MI96A2005

(51) Int. Cl.[7] ..... B66C 1/66; E04B 1/41
(52) U.S. Cl. ..... 52/707; 52/711; 294/89
(58) Field of Search ..... 294/89; 52/125.1, 52/125.4, 125.5, 698, 699, 702, 704, 707, 711

(56) References Cited

U.S. PATENT DOCUMENTS

| | | | | | |
|---|---|---|---|---|---|
| 758,707 | A | * | 5/1904 | Sicklesteel et al. | 52/711 |
| 1,887,455 | A | * | 11/1932 | Helberg | 52/707 |
| 3,712,014 | A | | 1/1973 | Waerner | |
| 3,873,147 | A | * | 3/1975 | Annable et al. | 294/89 |
| 4,018,470 | A | * | 4/1977 | Tye | 294/89 |
| 4,068,878 | A | | 1/1978 | Wilner | |
| 4,088,361 | A | * | 5/1978 | Ditcher | 294/89 |
| 4,179,151 | A | | 12/1979 | Tye | |

FOREIGN PATENT DOCUMENTS

| | | | | |
|---|---|---|---|---|
| AT | 248079 | * | 7/1966 | 294/89 |
| DE | 2 016 301 | | 11/1970 | |
| DE | 2142066 | | 2/1973 | |
| DE | 2437417 | * | 2/1976 | 294/89 |
| DE | 150 587 | | 9/1981 | |
| DE | 0 152 323 | | 11/1981 | |
| DE | 8 414 736 | | 5/1984 | |
| DE | 3 415 493 | | 10/1984 | |
| EP | 0 655 412 | | 5/1995 | |
| FR | 587938 | * | 4/1925 | 294/89 |
| FR | 2 504 900 | | 11/1982 | |
| GB | 2 139 278 | | 11/1984 | |
| GB | 2150910 | * | 7/1985 | 294/89 |
| SU | 740685 | * | 6/1980 | 294/89 |
| SU | 981187 | * | 12/1982 | 294/89 |
| SU | 981 187 | | 12/1982 | |

* cited by examiner

*Primary Examiner*—Johnny D. Cherry
(74) *Attorney, Agent, or Firm*—Guido Modiano; Albert Josif; Daniel O'Byrne

(57) ABSTRACT

An anchoring element for lifting prefabricated components, made of concrete, comprising a hollow body of a bayonet coupling device which forms a female seat with an access opening; the hollow body is embeddable in a component proximate to a perimetric side of the component so that the access opening is directed outward.

18 Claims, 5 Drawing Sheets

DEVICE FOR LIFTING PREFABRICATED COMPONENTS, PARTICULARLY MADE OF CONCRETE, OR THE LIKE

This is a division of application Ser. No. 08/937,692 filed Sep. 29, 1997, now U.S. Pat. No. 6,092,849.

BACKGROUND OF THE INVENTION

The present invention relates to a device for lifting prefabricated components, particularly made of concrete, or the like.

Specifically provided devices are conventionally used to allow lifting of prefabricated concrete components and can be grouped substantially into three categories.

A first category of devices is substantially constituted by elements which are embedded in the concrete component during its manufacture and protrude from a perimetric side of the component so that they can be engaged by lifting equipment, such as cranes.

The element that is embedded in the component and protrudes from it in order to be engaged is generally substantially constituted by an iron rod which is shaped like a ring, hook, eyelet or stirrup or by a plate, so that it can be easily engaged directly by the hook of the lifting crane.

Devices that belong to this first category are now obsolete and are almost no longer in use, since the presence of an element that protrudes from the volume of the concrete component is undesirable both for aesthetic reasons and for functional reasons, since it hinders the installation of the component and it must very often be removed.

A second category of devices is constituted by anchoring elements which are plate-shaped or nail-shaped or otherwise shaped and do not protrude from the profile of the component because they are embedded proximate to a perimetric side of the component, providing around them, on said side of the component, a suitable cavity in order to allow their engagement by means of lifting shackles which are connected to the crane.

In practice, these devices that belong to the second category are composed of three basic elements: an anchoring element to be embedded in the component; a throwaway or reusable mold to produce the cavity around the portion of the anchoring element that must be engaged; and a shackle for engaging the anchoring element which is embedded in the component.

Devices that belong to this second category, while solving the problems of the devices of the first category described above, since they do not produce protrusions from the profile of the component, entail problems mainly during the casting of the component, since it is necessary to use the mold to form the cavity around the portion of the anchoring element that is meant to be engaged by the shackle.

Another problem that can be observed in devices of this second category is the fact that the need to have a cavity of suitable size around the element embedded in the concrete component allows use of this device only in rather thick concrete components.

A third category of lifting devices is constituted by anchoring elements which are embedded in the body of the component proximate to one of its perimetric sides and which instead of requiring the provision of a specifically-executed cavity to allow the engagement of the anchoring element by the lifting equipment, have a seat in which a second element is detachably engaged; said second element is meant to protrude from the perimetric side of the component in order to be engaged by the lifting equipment.

In devices that belong to this category, the anchoring element is constituted by a threaded bush which is embedded in the concrete component during its casting, proximate to a perimetric side of the component, so that the opening for accessing said threaded cavity is directed outward.

A threaded pin, meant to protrude from the profile of the concrete component, is then coupled by screwing in said threaded cavity and engaged by the lifting equipment.

Devices that belong to this category considerably simplify the execution of the component, since they do not require use of special molds in order to form a cavity in the concrete component; however, they entail some problems.

In particular, the threaded coupling of the element meant to be engaged by the lifting equipment with the threaded cavity of the bush embedded in the concrete component is not capable of offering adequate assurances of safety, since correct execution of the threaded coupling is entrusted to the operator.

Moreover, since components are usually handled in an environment which is rich in dust and sand, dirt may seep into the threaded cavity, making it difficult to provide correct coupling to the threaded pin, which is meant to be engaged by the lifting equipment.

Furthermore, owing to the fact that the threaded pin is used several times to handle several components, wear of said part is noted; after repeated screwing and unscrewing operations, said wear makes it difficult to couple said pin to the threaded cavities of the anchoring elements embedded in the concrete components.

The gradual increase of the wear of the threaded pin also significantly reduces the degree of safety of the coupling, since said wear can be the primary cause of an accidental release of the component when it is lifted.

Moreover, the coupling of the threaded pin to the bush embedded in the concrete component is relatively slow and troublesome to perform.

Another problem is the fact that the threaded bush has strength problems when the lifting of the component also includes a step for overturning the component, with shearing stresses that concentrate on the threaded bush.

SUMMARY OF THE INVENTION

The aim of the present invention is to solve the above problems by providing a device for lifting prefabricated components, particularly made of concrete, or the like, which is very simple both during execution and during use.

Within the scope of this aim, an object of the invention is to provide a device which offers adequate safety assurances against accidental release of the component during lifting.

Another object of the invention is to provide a device in which the degree of safety against accidental release during lifting of the component is achieved automatically regardless of the operator skill.

Another object of the invention is to provide a device which is composed of structurally simple elements which can be manufactured with low costs, particularly as regards the part of the device that is meant to be embedded in the prefabricated component.

Another object of the invention is to provide a device which is highly resistant both to axial loads and to transverse loads, so as to allow both simple lifting of the component and combined lifting and overturning thereof.

This aim, these objects and others which will become apparent hereinafter are achieved by an anchoring element for lifting prefabricated components, made of concrete, comprising a hollow body of a bayonet coupling device which forms a female seat with an access opening, said hollow body being embeddable in a component proximate to a perimetric side of the component so that said access opening is directed outward.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 2:
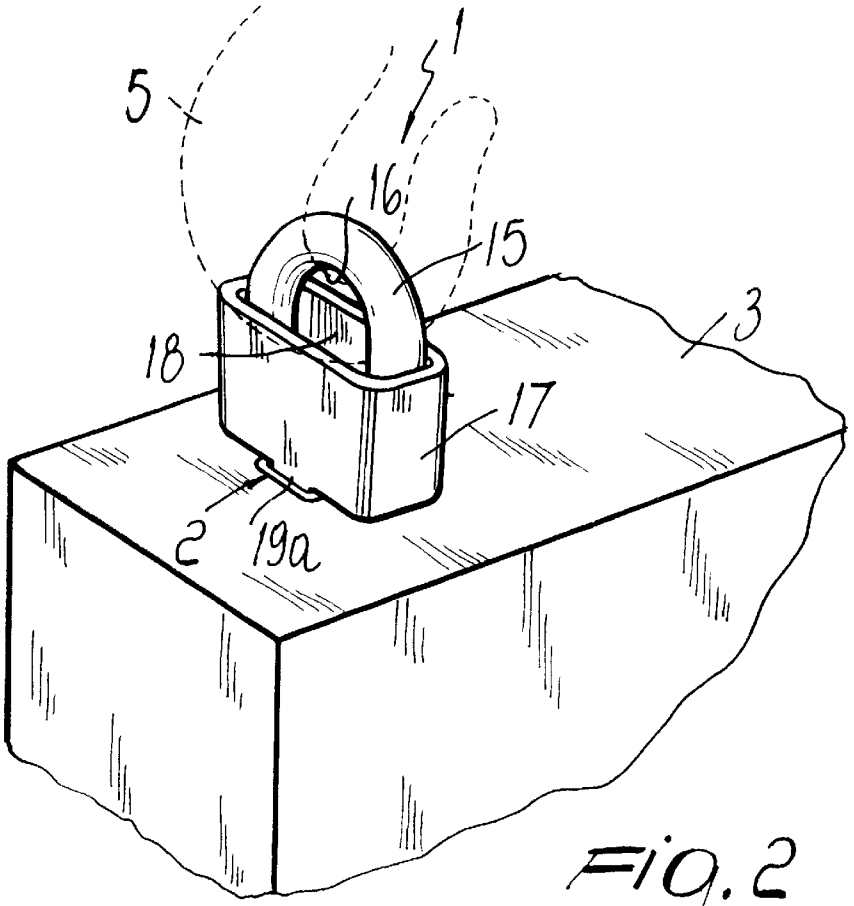
FIG. 2 is a perspective view of the device according to the invention during the lifting of the component.
Figure 1:
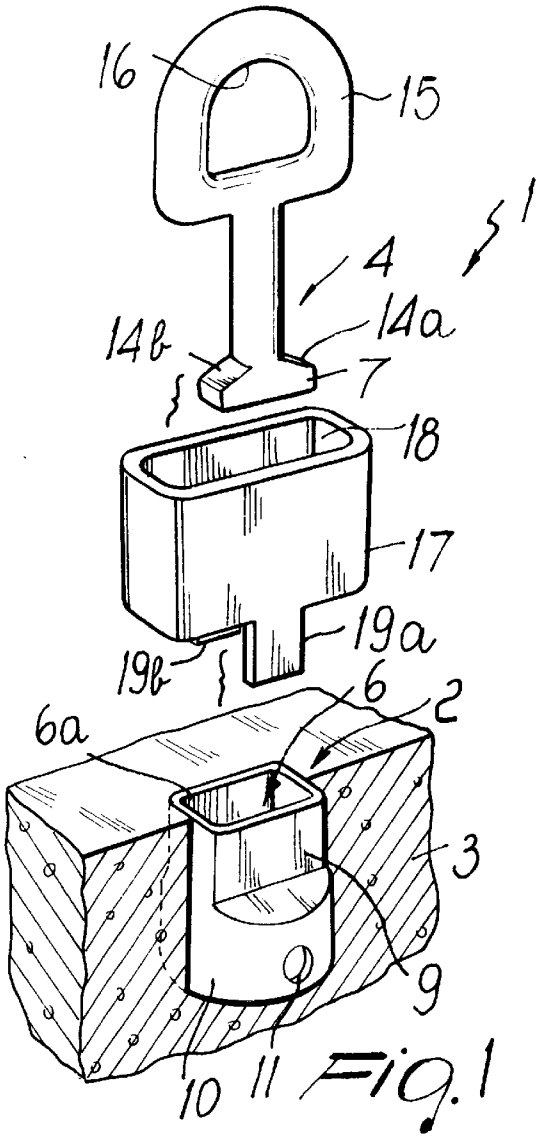
FIG. 1 is an exploded perspective view of a lifting device including the anchoring elements according to the invention, showing the anchoring element embedded in a concrete component, which is shown in cross-section.
Figure 3:
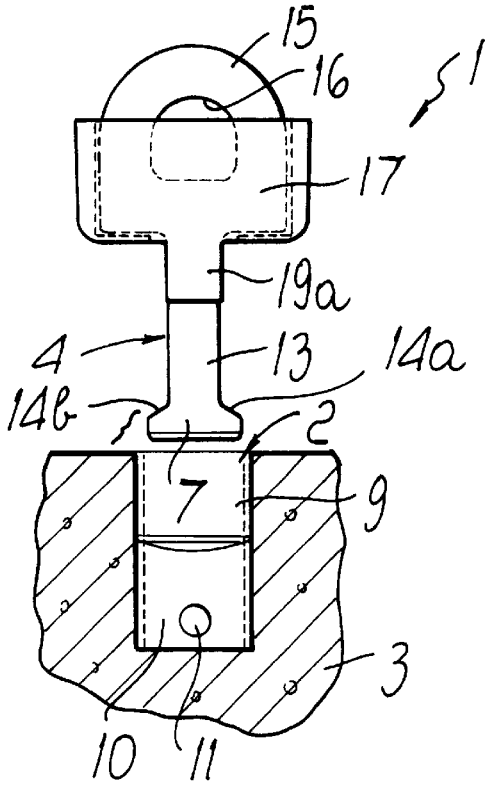
FIGS. 3 to 12 are schematic views of the sequence of the coupling between the anchoring element and the engagement element: the even-numbered figures illustrate the lifting device on a plane which is perpendicular to the view shown in the odd-numbered figures.
Figure 4:
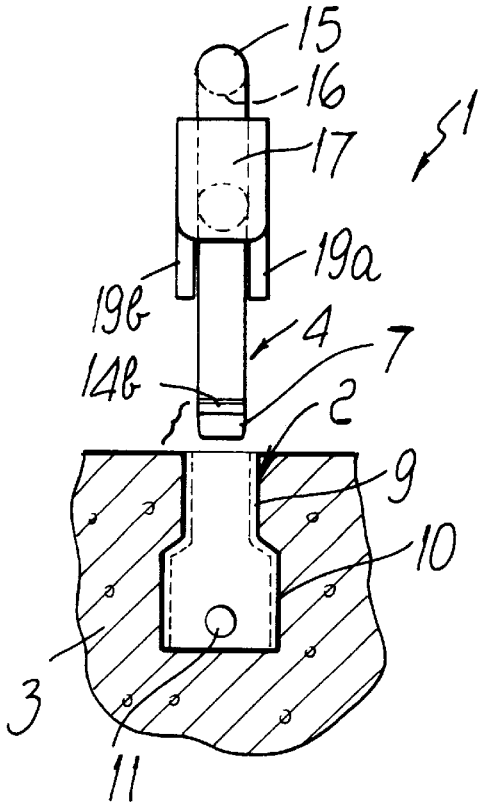
Figure 5:
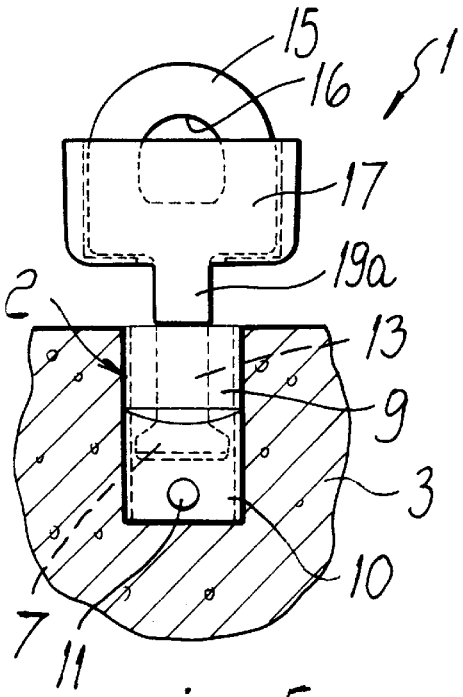
Figure 6:
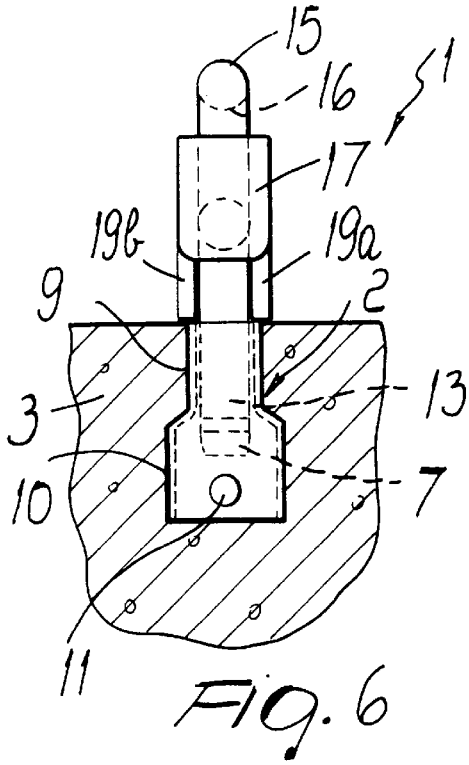

With reference to FIGS. 1 to 14, the device according to the invention, generally designated by the reference numeral 1, comprises an anchoring element 2, which is meant to be embedded in a component 3 during its molding, and an engagement element 4, which is meant to couple to the anchoring element 2 and a portion whereof forms an engagement region for lifting equipment constituted for example by the hook 5 of a crane.

The anchoring element 2 forms a female seat 6 of a bayonet coupling device with which a male end 7 of the engagement element of the bayonet coupling can be coupled.

The anchoring element 2 is meant to be embedded in the component 3 during its molding, proximate to a perimetric side of the component, so that an access opening 6*a* of the female seat 6 is located at said perimetric side and is open outward in order to allow the insertion of the end 7 of the engagement element 4 in the female seat 6.

The female seat 6 of the anchoring element 2 has, starting from the access opening 6*a*, a first portion 6*b* through which the end 7 of the engagement element 4, moved axially along the seat 6 with respect to the anchoring element 2, can pass, and a second portion 6*c* which forms at least one axial shoulder 8*a*, 8*b* which can be engaged by the end 7 of the engagement element 4 as a consequence of the partial rotation of the engagement element 4 with respect to the anchoring element 2 about the longitudinal axis of the female seat 6.

This rotation, which completes the bayonet coupling between the engagement element 4 and the anchoring element 2, covers preferably substantially 90°.

Conveniently, the anchoring element 2 is substantially constituted by a steel tubular body which internally forms the female seat 6.

The tubular body has an open axial end so as to form the access opening 6*a* and has, in an intermediate region of its extension, at least one raised portion which protrudes from its internal surface and covers a limited arc about its axis, so as to form the at least one axial shoulder 8*a*, 8*b*.

More particularly, the tubular body that constitutes the anchoring element 2 has, starting from the access opening 6*a*, a first portion 9 which has, in transverse cross-section, a shape which is other than circular and is preferably complementary to the shape of the end 7 of the engagement element 4, and a second portion 10 which has, in a transverse cross-section, a substantially circular shape or a shape which is limited to one or more circular sectors in order to allow the end 7 of the engagement element to rotate about the axis of the tubular body after passing from the first portion 9 to the second portion 10.

The axial shoulder or shoulders 8*a*, 8*b* are formed by the region for passage between the first portion 9 and the second portion 10. The passage region can be substantially perpendicular to the axis of the tubular body that constitutes the anchoring element 2 or can be inclined or can also be radiused according to requirements.

The configuration of the first portion 9 can be achieved, starting from a substantially cylindrical tubular body, through a partial deformation of an end region of said tubular body.

The first portion 9 preferably has a substantially rectangular shape in transverse cross-section, as shown in the various figures of the accompanying drawings; however, it may also have other shapes, such as for example a substantially rectangular shape in which the shorter and/or longer sides are curved and convex or concave on the outward-facing side, or a substantially elliptical configuration, or a substantially diamond-like configuration or in any case such a configuration as to allow the insertion of the end 7 and form, in the passage between the first portion 9 and the second portion 10, which preferably has a circular cross-section, one or more axial shoulders 8*a*, 8*b* as described above.

The anchoring element 2 has, proximate to the end which lies opposite to the access opening 6*a*, a region with enhanced anchoring.

This region can be constituted simply by a through hole 11 arranged transversely to the axis of the tubular body and meant to be crossed by a rod to be embedded in the body of the component during its manufacture.

It is also possible to provide two holes 11 which are mutually axially and radially offset by an angle of preferably 90° for the passage of two reinforcement rods which are preferably mutually perpendicular.

The enhanced anchoring region may also have other configurations, as shown in particular in FIGS. 15 to 19.

Figure 15:
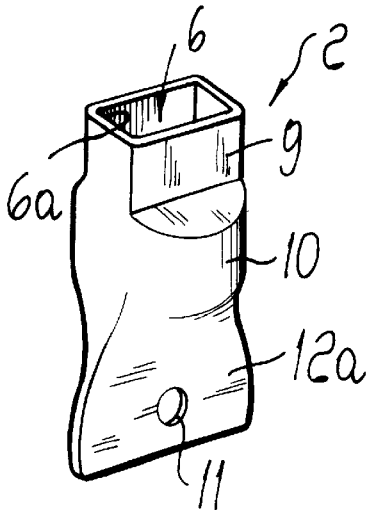
FIGS. 15 to 19 are perspective views of different embodiments of the anchoring element of the device according to the invention.

As shown in FIG. 15, the enhanced anchoring region may be constituted by a substantially flattened compressed end portion 12*a* of the tubular body that constitutes the anchoring element 2.

Figure 16:
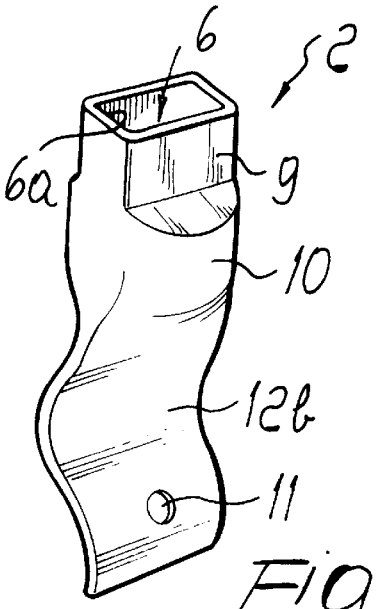
Figure 17:
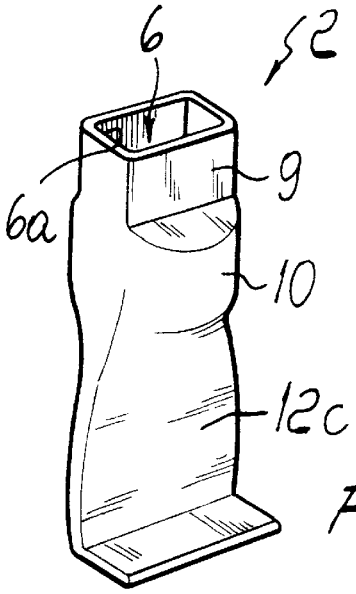

As shown in FIG. 16, the enhanced anchoring region may be constituted by an end portion 12*b* of the tubular body which is compressed and undulated transversely to the axis of the tubular body or, as shown in FIG. 17, by an end portion 12*c* which is flattened and folded transversely to the axis of the tubular body that constitutes the anchoring element 2.

Figure 18:
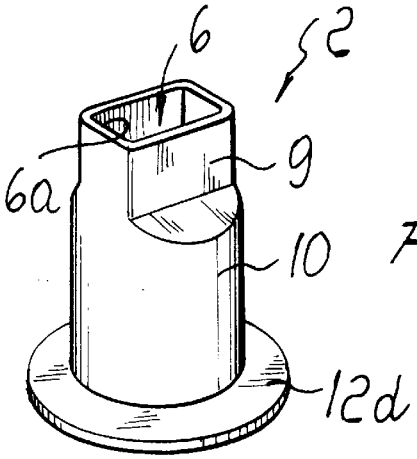

As shown in FIG. 18, the enhanced anchoring region can also be constituted by a plate 12*d* which is fixed, for example by welding, to the tubular body that constitutes the anchoring element 2, and is arranged on a plane which is substantially perpendicular to the axis of said tubular body.

It should be noted that the enhanced anchoring region may also be simply constituted by an outward flaring of the end of the tubular body that constitutes the anchoring element 2 and is directed away from the access opening 6*a*.

Figure 19:
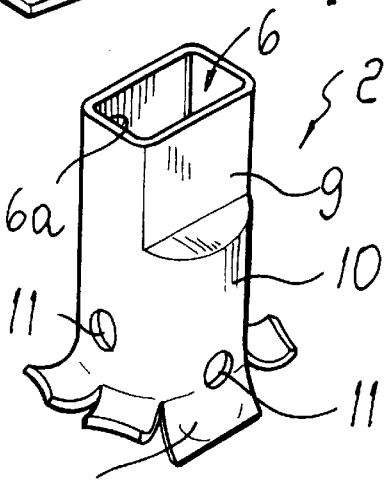

As shown in FIG. 19, the enhanced anchoring region can be constituted by a jagged flaring 12*e* with lips which are folded outward in order to increase the resistance of the anchoring element 2 to extraction from the concrete.

Another embodiment of the enhanced anchoring region can also be constituted by a rod which is optionally bent or undulated and screwed or welded to the end of the tubular body that constitutes the anchoring element 2 that lies opposite to the access opening 6*a*.

The engagement element 4 substantially comprises a shaft 13, an axial end of which constitutes the male end 7 meant to couple to the female seat 6 of the anchoring element 2.

More particularly, the shaft 13 has, at least in its portion meant to be inserted in the female seat 6, a diameter which is smaller than the minimum transverse size of the first portion 9 of the female seat 6, and the end 7 is constituted by at least one lateral protrusion which can be inserted in the second portion 6*b* of the female seat 6 and forms at least one axial shoulder 14*a*, 14*b* which can engage the axial shoulder 8*a*, 8*b* of the female seat.

Preferably, as shown in the embodiment illustrated in the accompanying drawings, the end 7 of the shaft 13 is constituted by two lateral protrusions which protrude from mutually diametrically opposite regions so as to form two axial shoulders 14*a*, 14*b*.

The end 7 can also be constituted by a plurality of lateral protrusions so as to have, in a cross-section taken transversely to the axis of the shaft 13, a shape which is complementary to the inside of the first portion 9 of the tubular body that constitutes the anchoring element 2.

Advantageously, the end of the shaft 13 that lies opposite to the end 7 is shaped like a handle 15 and preferably forms a slot 16 in which the hook 5 of a lifting crane can be inserted.

Conveniently, the lifting device also comprises means for locking the engagement element 4 in the position for coupling to the female seat 6.

The locking means comprise a locking element 17 which prevents the rotation of the engagement element 4 with respect to the anchoring element 2 about the axis of the shaft 13 when the two elements of the bayonet coupling device, i.e., the male end 7 and the female seat 6, are correctly coupled.

More particularly, the locking element 17 is jointly coupled to the shaft 13 in its rotation about its axis and is fitted so that it can slide axially along the shaft 13. The locking element 17 is provided with a locking portion which is preferably constituted by two wings 19*a* and 19*b*, can be inserted in the first portion 9 of the tubular body and constitutes the element 2 for mutually anchoring the shaft 13 and the inner surface of the first portion 9, when the male end 7 of the engagement element 4 is coupled to the female seat 6 in order to rigidly couple the locking element 17 and the anchoring element 2 in their rotation about the axis of the shaft 13.

The mutual connection of the locking element 17 and of the engagement element 4 in their rotation about the axis of the shaft 13 is preferably achieved by means of a compartment 18 which at least partially accommodates the handle 15.

The axial sliding of the locking element 17 with respect to the engagement element 4 furthermore causes the locking element 17 to at least partially cover the handle 15 before the insertion of the wings 19*a* and 19*b* of the locking element 17 in the first portion 9 of the tubular body that constitutes the anchoring element 2, making it impossible to access the slot 16 and thus safely eliminating the possibility that the engagement element 4 might be engaged by the hook 5 of a lifting crane, as will become apparent hereinafter.

When the engagement element 4 is correctly coupled to the anchoring element 2, the handle 15 is preferably on a plane which is substantially perpendicular to the plane of arrangement of the larger faces of the prefabricated component if said component is constituted by a concrete panel.

In the case of pillars, beams, curved roofing panels or other components, it is instead preferably in a vertical position.

Operation of the lifting device according to the invention is as follows.

The anchoring element 2 is first embedded in the body of the component 3 during its molding, placing it proximate to a perimetric side of the component so that the access opening 6*a* is at a face of the component. During this step, the access opening 6*a* is protected with a plug which is subsequently meant to be removed and is not shown for the sake of simplicity; likewise, the opposite end of the tubular body that constitutes the anchoring element 2 is also protected, if it is open, leaving the region optionally occupied by the hole or holes 11 free for the passage of reinforcement rods.

When it is necessary to lift the component, the engagement element 4, with the locking element 17 fitted on the engagement element 4 so as to accommodate most of the handle 15 inside the compartment 18, is inserted by means of an axial movement with the male end 7 in the female seat 6.

During insertion, the male end 7 passes through the first portion 9 of the tubular body that constitutes the anchoring element 2, as shown in FIGS. 3 to 6, until it reaches the second portion 10.

In this position, the locking element 17 rests, with its wings 19*a* and 19*b* on the longer sides or edge of the access opening 6*a* and the handle 15 is still substantially completely accommodated in the compartment 18. In this position, the handle 15 cannot be engaged by the hook 5 of a lifting crane, since the slot 16 cannot be accessed by the hook because it is partially closed by the presence of the locking element 17. Accordingly, the element 4 cannot be engaged during this step of the coupling.

Figure 7:
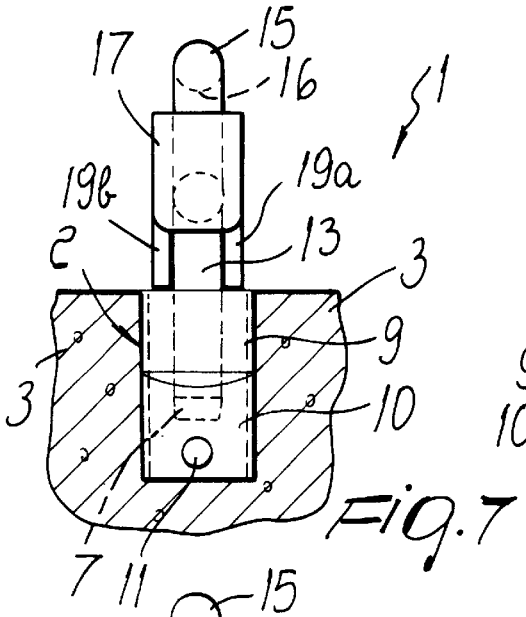
Figure 8:
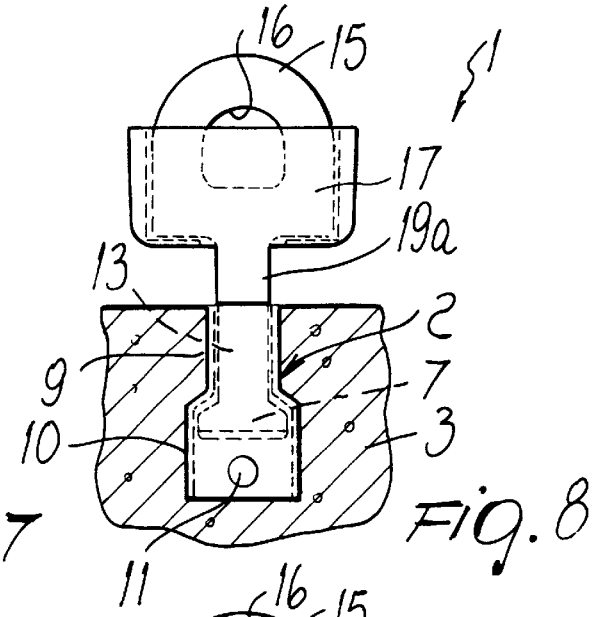

The engagement element 4 and the locking element 17 are then rotated about the axis of the shaft 13 with respect to the anchoring element 2 with a rotation which covers preferably substantially 90°, for moving the shoulders 14*a* and 14*b* so as to face the shoulders 8*a* and 8*b*, as shown in FIGS. 7 and 8.

Figure 9:
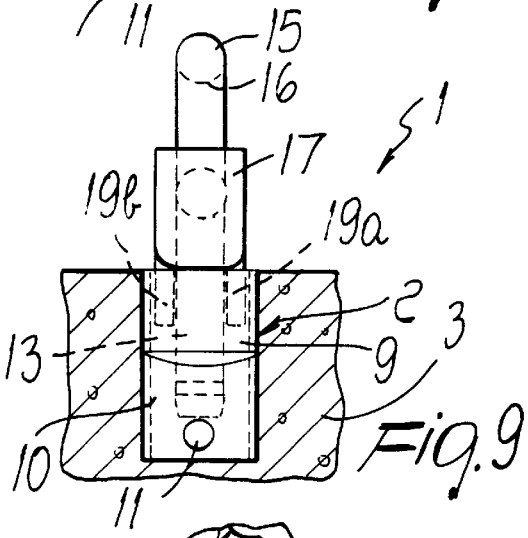
Figure 10:
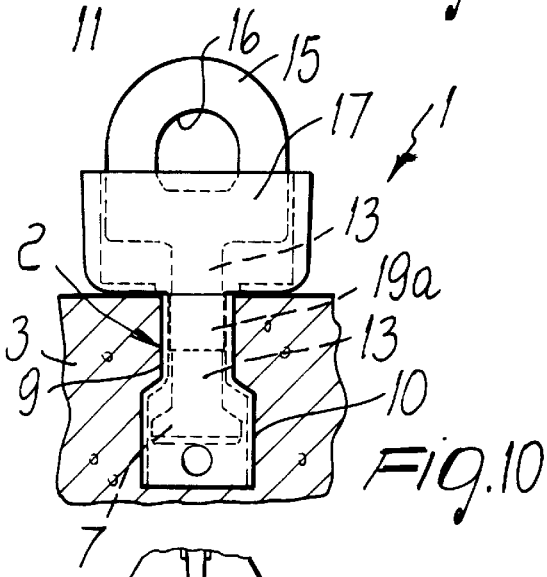

In this position, the locking element 17 descends automatically by gravity or can be pushed, so as to place the wings 19*a* and 19*b* inside the first portion 9 of the tubular body that constitutes the anchoring element 2, as shown in FIGS. 9 and 10.

Figure 11:
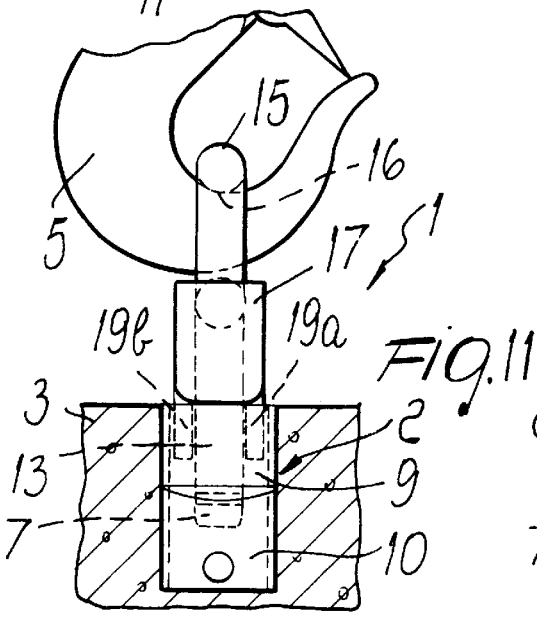
Figure 12:
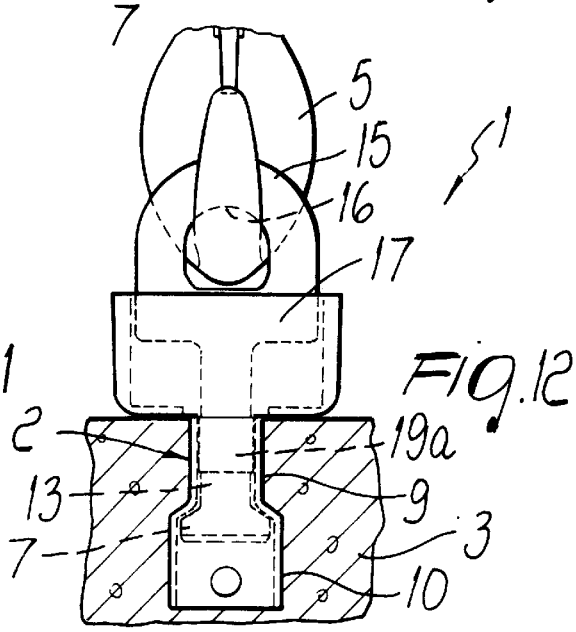

In this manner the dual effect of jointly rotationally coupling the engagement element 4 and the anchoring element 2, safely preventing the engagement element 4 from accidentally disengaging from the anchoring element 2, is obtained, and at the same time the slot 16 of the handle 15 is freed, allowing the hook 5 of a crane or of other lifting equipment to engage the slot 16, as shown in FIGS. 11 and 12.

It is important to note that until the bayonet coupling between the engagement element 4 and the anchoring element 2 has been performed completely, it is impossible to engage the engagement element 4.

Figure 14:
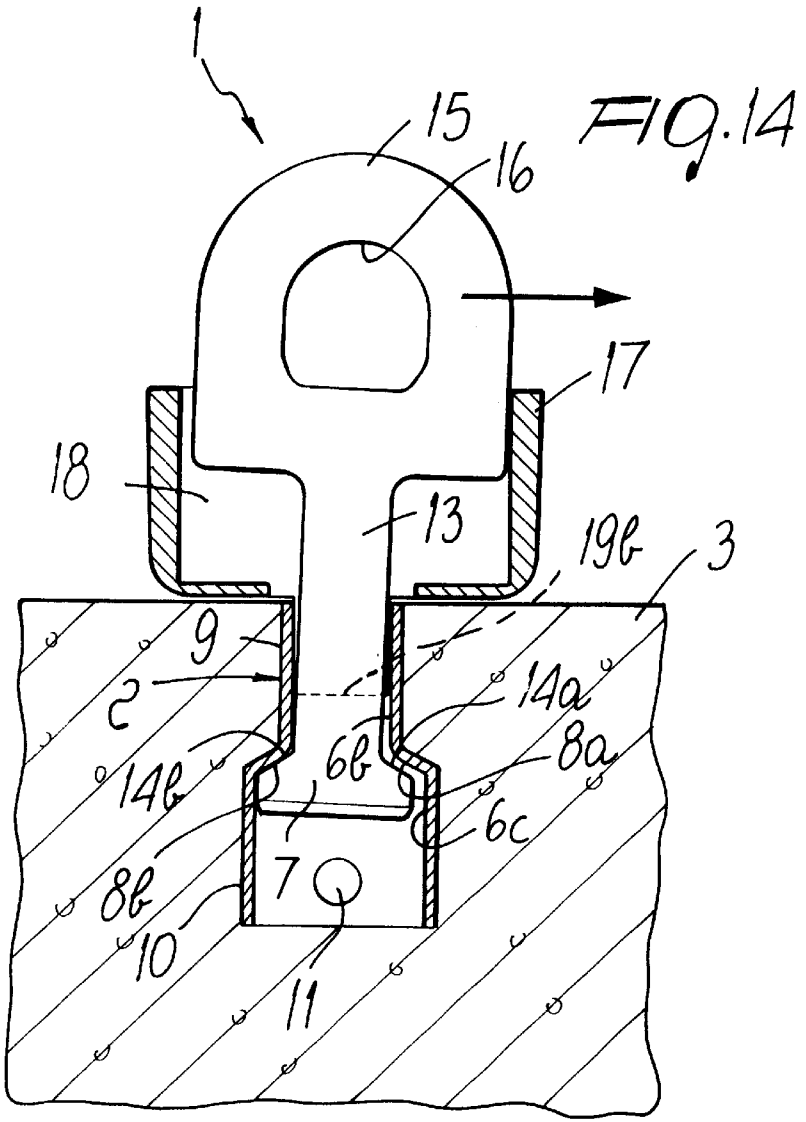
FIG. 14 is a view, similar to FIG. 13, of the device according to the invention during combined lifting and partial overturning of the component.
Figure 13:
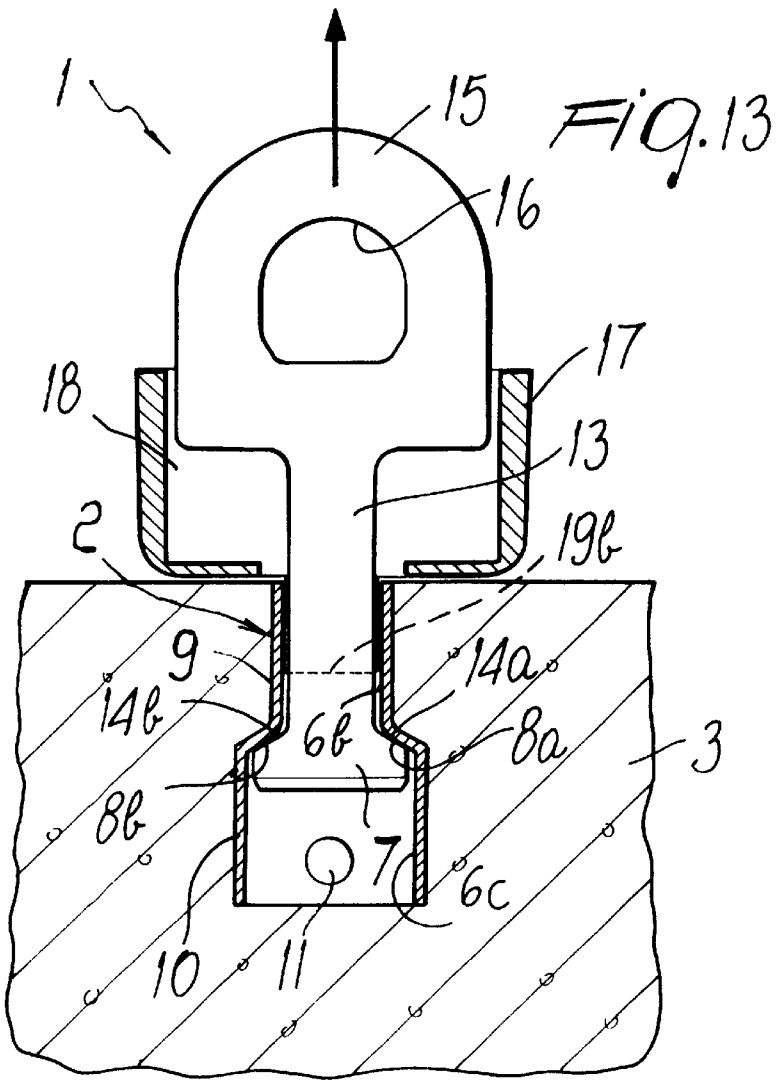
FIG. 13 is a partially sectional view of the device according to the invention during simple lifting of the component.

If the component is simply lifted vertically, as shown in FIG. 13, the shoulders 14*a* and 14*b* rest against the shoulders 8*a* and 8*b*, sharing the lifting load, whilst if the component is partially overturned, as shown in FIG. 14, one of the shoulders 14*a* or 14*b* couples to one of the shoulders 8*a* or 8*b*. The structure of the lifting device is in any case such as to ensure adequate strength even in these conditions.

In practice, it has been observed that the lifting device according to the invention fully achieves the intended aim and objects, since it combines the advantages of lifting devices that do not have parts which protrude from the component and do not require cavities at the anchoring element embedded in the component with great practicality in engaging the component and with high safety against accidental disengagements of the component during lifting.

Another advantage of the device according to the invention is that it can be manufactured at an extremely low cost.

The device thus conceived is susceptible of numerous modifications and variations, all of which are within the scope of the inventive concept; all the details may furthermore be replaced with other technically equivalent elements.

In practice, the materials employed, as well as the dimensions, may be any according to requirements and to the state of the art.

What is claimed is:

1. An anchoring element for lifting prefabricated components, made of concrete, comprising a hollow body of a bayonet coupling device which forms a female seat with an access opening, said hollow body being embeddable in a component proximate to a perimetric side of the component so that said access opening is directed outward, said hollow boy comprising a tubular body having a longitudinal extension along an axis thereof which internally forms said female seat, said tubular body having an open axial end which forms said access opening and, in an intermediate region of its extension, at least one inclined raised portion which protrudes from its internal surface and covers a limited are about its axis, said at least one raised portion forming at least one inclined axial shoulder.

2. The anchoring element according to claim 1, wherein said tubular body has, starting from said open end, a first portion which has, in a transverse cross-section, a shape which is different from circular and a second portion which has, in a transverse cross-section, substantially a shape chosen among a circle and a circular sector or sectors, said at least one axial shoulder being formed by a region for passage between said first portion and said second portion.

3. The anchoring element according to claim 2, wherein said shape of said first portion of the tubular body being different from circular is provided deforming a portion of said tubular body.

4. The anchoring element according to claim 3, wherein said tubular body is made of metallic material.

5. The anchoring element according to claim 2, wherein said first portion is substantially rectangular in a transverse cross-section.

6. The anchoring element according to claim 2, wherein said first portion has, in a transverse cross-section, a substantially rectangular configuration in which the shorter and/or longer sides are curved and convex or concave on the outward-facing side.

7. The anchoring element according to claim 2, wherein said first portion is substantially elliptical in a transverse cross-section.

8. The anchoring element according to claim 2, wherein said first portion is substantially diamond-shaped in a transverse cross-section.

9. The anchoring element according to claim 1, further comprising an enhanced anchoring region on the opposite side with respect to said open end of the tubular body.

10. The anchoring element according to claim 9, wherein said enhanced anchoring region is constituted by a flattened end portion of said tubular body.

11. The anchoring element according to claim 9, wherein said enhanced anchoring region is constituted by a flattened end portion of said tubular body which is undulated transversely to the axis of the tubular body.

12. The anchoring element according to claim 9, wherein said enhanced anchoring region is constituted by a flattened end portion of said tubular body which is folded transversely to the axis of the tubular body.

13. The anchoring element according to claim 9, wherein said enhanced anchoring region is constituted by a plate which is rigidly fixed to said tubular body and is arranged substantially at right angles to the axis of said tubular body.

14. The anchoring element according to claim 9, wherein said enhanced anchoring region is constituted by an end portion of said tubular body which is flared outward.

15. The anchoring element according to claim 9, wherein said enhanced anchoring region is constituted by a jagged flared portion with lips which are folded outward.

16. The anchoring element according to claim 9, wherein said enhanced anchoring region is constituted by a rod which is rigidly fixed to said tubular body and is arranged along its axis.

17. The anchoring element according to claim 9, wherein said enhanced anchoring region is constituted by a rod which is rigidly fixed to said tubular body, is arranged along its axis and is folded or undulated.

18. The anchoring element according to claim 9, wherein in said enhanced anchoring region there is provided at least one through hole which is orientated so that its axis lies transversely to the axis of said tubular body.

* * * * *